US012796758B2

(12) United States Patent
Lindamood

(10) Patent No.: US 12,796,758 B2
(45) Date of Patent: Nov. 17, 2026

(54) GI ASSEMBLY

(71) Applicant: Greg Lindamood, Midlothian, TX (US)

(72) Inventor: Greg Lindamood, Midlothian, TX (US)

( * ) Notice: Subject to any disclaimer, the term of this patent is extended or adjusted under 35 U.S.C. 154(b) by 0 days.

(21) Appl. No.: 19/374,804

(22) Filed: Oct. 30, 2025

(65) Prior Publication Data

US 2026/0114528 A1 Apr. 30, 2026

Related U.S. Application Data

(60) Provisional application No. 63/713,948, filed on Oct. 30, 2024.

(51) Int. Cl.
*A41F 9/02* (2006.01)
*A41D 1/08* (2018.01)

(52) U.S. Cl.
CPC ..... *A41F 9/025* (2013.01); *A41D 1/08* (2013.01)

(58) Field of Classification Search
CPC ..... A41F 9/025; A41D 1/08
See application file for complete search history.

(56) References Cited

U.S. PATENT DOCUMENTS

| | | | | | |
|---|---|---|---|---|---|
| 1,891,815 | A * | 12/1932 | Heidrich | D05B 91/02 | 223/103 |
| 4,671,437 | A * | 6/1987 | Sauger | D05B 91/02 | 223/102 |
| 5,353,972 | A * | 10/1994 | Mandel | D05B 91/02 | 223/103 |
| 5,524,800 | A * | 6/1996 | Arney | D05B 91/02 | 2/243.1 |
| 5,785,215 | A * | 7/1998 | Hinkel | D05B 91/00 | 223/103 |
| 9,334,595 | B2 * | 5/2016 | Archibeck | D05B 91/02 | |
| 2011/0240690 | A1 * | 10/2011 | Newsom | D05B 91/02 | 223/50 |

* cited by examiner

*Primary Examiner* — Gloria M Hale
(74) *Attorney, Agent, or Firm* — Law Office of Jeff Williams PLLC; J. Oliver Williams

(57) ABSTRACT

An assembly for tying Gi pants includes an elongated body for holding a drawstring. The body is hollowed and elongated and has a first end and a second end. A groove is made in the side of the body from the second end and stopping before the first end. The groove exposes an interior of the elongated body. A notch is formed in the first end and is separate from the groove. The notch has a notch bottom to allow for a knot on the drawstring to seat therein. The method includes passing the drawstring through the groove and tying a knot in the drawstring at the first end. The knot is secured in the notch. The body and the drawstring are passed together through the Gi pants. The knot is untied and the body is removed from the Gi pants while retaining the drawstring.

10 Claims, 2 Drawing Sheets

GI ASSEMBLY

CROSS REFERENCE TO RELATED APPLICATIONS

This application claims the benefit of an earlier filing date and right of priority to U.S. Provisional Application No. 63/713,948, filed 30 Oct. 2024, the contents of which is incorporated by reference herein in its entirety.

BACKGROUND OF THE INVENTION

1. Field of the Invention

The present application relates to a drawstring device, and more particularly to a device used in the replacing of broken drawstrings.

2. Description of Related Art

Martial arts, an ancient form of combat and self-defense, has a history deeply rooted in various cultures across the globe. Its origins can be traced back to prehistoric times, with evidence of organized combat and self-defense techniques depicted in early art and literature. These practices evolved into structured forms of martial arts in different civilizations, notably in Asia, where they were refined into sophisticated systems for physical development, self-protection, and cultural preservation. Ancient civilizations, including China, Japan, and Korea, significantly contributed to the development of martial arts, each incorporating unique philosophies, techniques, and training methods. Over centuries, these practices expanded beyond their regions of origin, influencing and integrating with martial disciplines worldwide, and evolving into modern forms such as karate, judo, taekwondo, jiu jitsu, and Kung fu.

Central to many martial arts disciplines is the Gi, a traditional uniform that has become synonymous with martial arts practice. Originating in Japan, the Gi was first popularized by Judo founder Jigoro Kano in the late 19th century as a standard training uniform. Designed for durability and freedom of movement, the Gi consists of a jacket, pants, and a belt, often color-coded to indicate the wearer's rank and skill level. The Gi's design facilitates various techniques and grappling moves essential to martial arts training. Over time, the Gi has been adopted by numerous martial arts styles, becoming an iconic symbol of discipline, respect, and tradition in martial arts culture. Its evolution mirrors the global spread and adaptation of martial arts, maintaining its importance in both traditional and modern martial arts practices.

Despite the popularity and widespread practice of martial arts, one common issue faced by practitioners is the frequent need to replace the drawstring in their Gi pants. The traditional drawstring design, while simple, often leads to frustration as the string can break or get lost during washing. Replacing a drawstring typically involves threading a new string through the waistband pocket, a tedious and time-consuming process that can be especially challenging during urgent situations, such as tournaments or competitions. The difficulty of pushing a string through the narrow, often long pocket results in wasted time and effort, causing significant inconvenience to martial artists.

This recurring problem disrupts the flow of training and competition, reducing efficiency and causing unnecessary stress. In competitive environments, the inability to quickly replace a broken drawstring can even impact performance and participation. The lack of an efficient, easy-to-use solution for replacing drawstrings in Gi pants has been a persistent issue, leaving martial artists to resort to makeshift methods that are often unreliable and ineffective. This gap in the market highlights the need for a practical tool that can simplify and expedite the drawstring replacement process, ensuring that practitioners can maintain focus on their training and performance without unnecessary interruptions.

Although strides have been made, shortcomings remain.

BRIEF SUMMARY OF THE INVENTION

It is an object of the present application to provide an assembly and method to aid in the re-stringing of drawstrings in Gi pants. It is desired that the body be reusable and configured to securely hold the drawstring as it is routed within the Gi pants.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
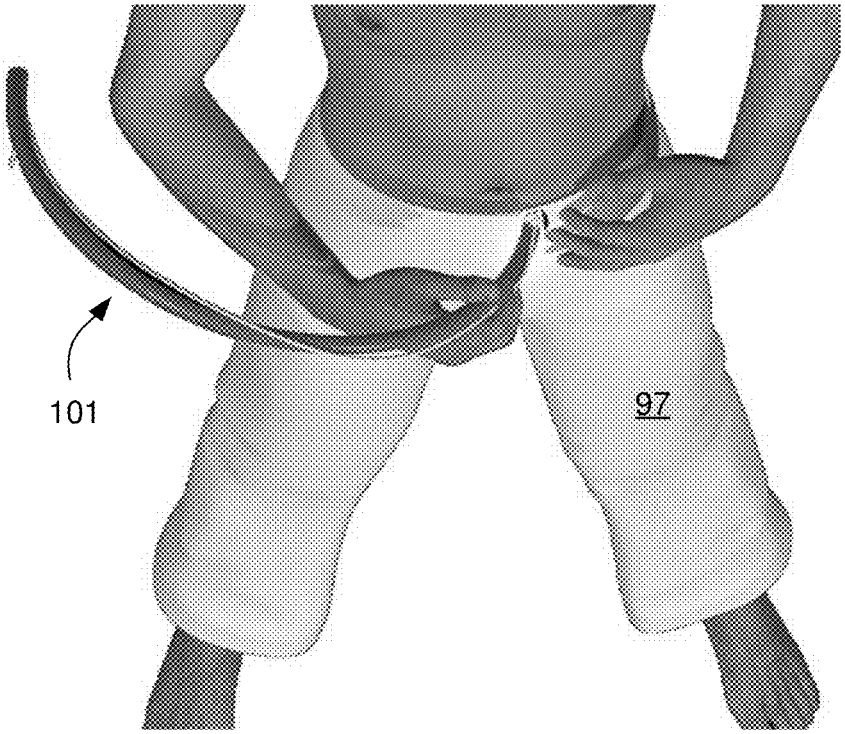
FIG. 1 is a perspective view of a GI assembly according to an embodiment of the present application with a pair of GI pants.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The Gi assembly of the present application is configured to offer a streamlined solution to the common problem of replacing broken drawstrings in martial arts Gi pants. Designed specifically to address the challenges faced by practitioners, the Gi assembly is a slender, tubular device equipped with a unique notch for securing a replacement drawstring. This innovative tool simplifies the process of threading a new string through the waistband pocket, making it quick and easy to restore the Gi pants to full functionality. This practical tool ensures that martial artists can swiftly address drawstring issues without disrupting their training or competition, providing a reliable solution that enhances convenience and reduces stress. The Gi assembly's lightweight, durable design makes it an essential accessory for any martial artist, ensuring they are always prepared for unexpected equipment issues.

Figure 2:
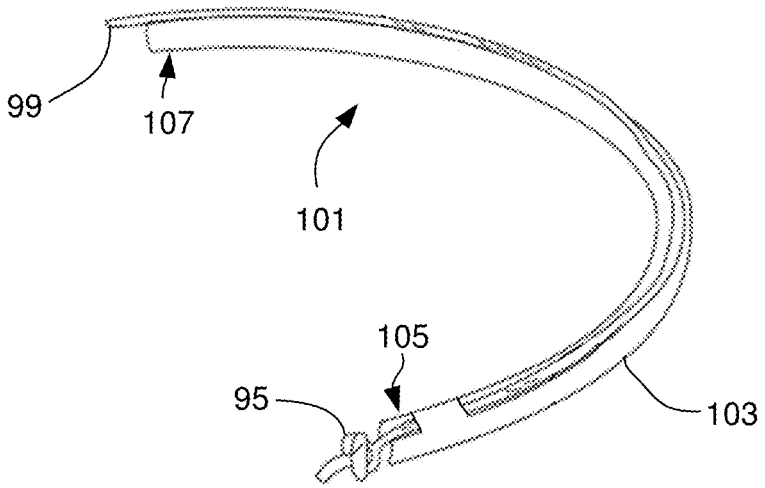
FIG. 2 is a perspective view of the GI assembly of FIG. 1.

Referring now to FIGS. 1-2 in the drawings, views of the Gi assembly 101 is illustrated. Gi assembly 101 is configured to work by securing one end of drawstring 99 at a first end of Gi assembly 101 and then subsequently inserting the first end into a drawstring pocket of Gi pants 97 as seen with FIG. 1. As the Gi assembly 101 is pushed through the pocket, it guides the string along the length of the waistband, efficiently replacing the broken or missing drawstring. Once the new string is in place, the Gi assembly is removed, and the knot is untied, leaving the drawstring ready to be tied and used.

As seen with FIG. 2, Gi assembly 101 is configured to be an elongated tubular body 103 having a first end 105 and a second end 107. The first end 105 of the body 103 is configured to accept a portion of a drawstring 99. This portion is typically formed into a knot 95 which is lodged or secured at first end 105. Knot 95 aids in pushing drawstring 99 through the pocket as it is inserted. Drawstring 99 is configured to lie externally to body 103 or may in fact pass internally within a defined passage on body 103. It is understood that body 103 may be formed to any length.

Figure 3:
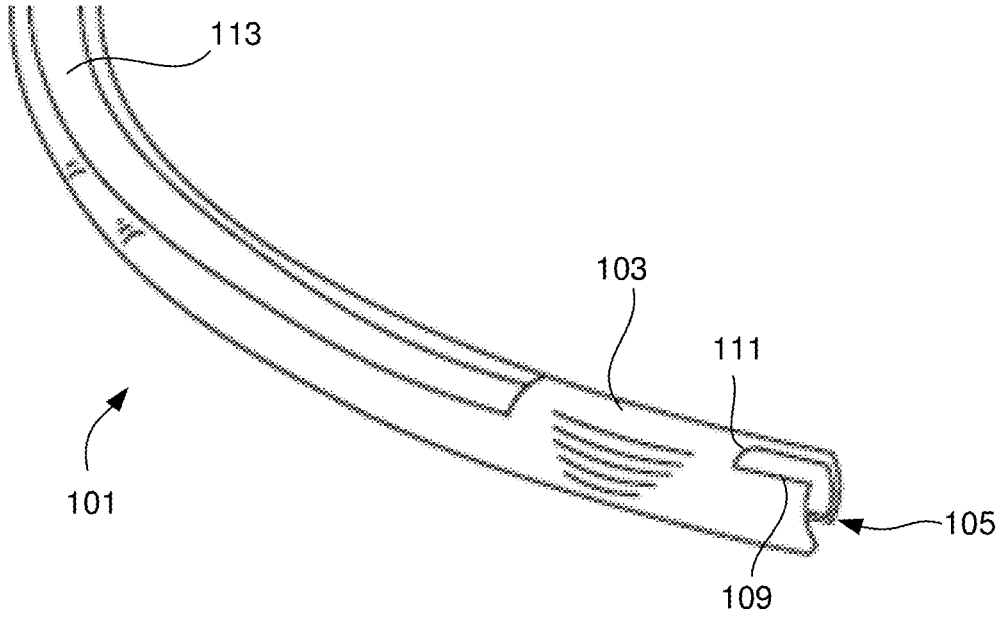
FIG. 3 is a partially enlarged view of the GI assembly of FIG. 1.
Figure 4:
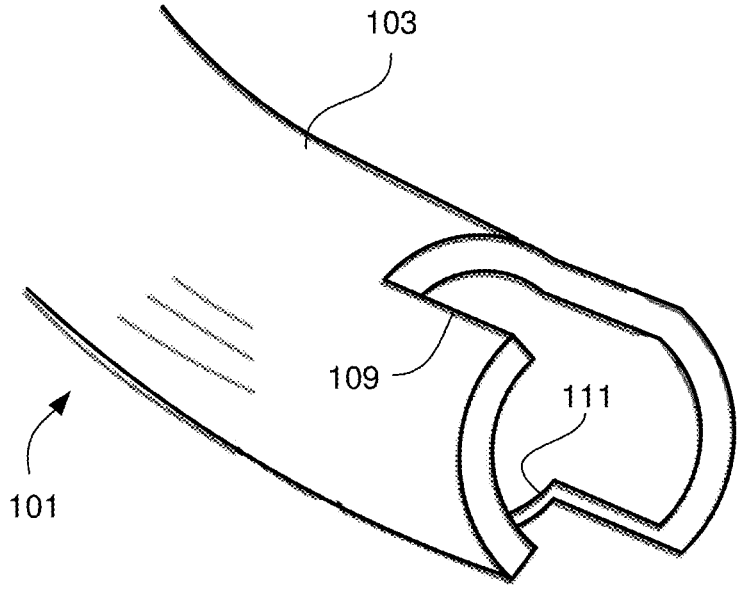
FIG. 4 is an enlarged view of an end of the GI assembly of FIG. 3.

Referring now also to FIGS. 3 and 4 in the drawings, enlarged views of Gi assembly 101 are illustrated. Body 103 is enlarged for better viewing at first end 105. Drawstring 99 is removed for clarity. To prevent drawstring 99 from getting stuck in the drawstring pocket during insertion, body 103 is configured to include a notch 109. Notch 109 is formed by removing a section of first end 105 on opposing sides of the cylindrical body. Notch 109 is configured to pass through 2 sides of the cylindrical body 103. In operation, knot 95 is configured to be larger than the opening of notch 109 which thereby prevents drawstring 99 from pulling out in the pocket. Notch 109 extends inward along the length of body 103 a set distance until it reaches the notch bottom 111. Notch 109 is formed by removing opposing sides of body 103. Notch 109 is designed to contain the temporary knot at the end of the replacement drawstring, preventing it from being pulled through notch bottom 111. Unremoved sides of body 103 at first end 105 are configured to help hold and securely locate the knotted end 95 of the drawstring within body 103.

Body 103 is a tubular body in a cylindrical form. The cross section of its perimeter is generally that of a circle. Body 103 is further configured to include a groove 113 along a portion of its length. The groove 113 is formed by removing or separating the body along a selected line in its length. This line of separation does not pass through opposing sides of the tubular/circular shaped body 103. Groove 113 is configured to expose the interior of the hollowed body

103. Groove 113 is configured to allow drawstring 99 to be held internally within the hollowed body 103 while being pushed through the drawstring pocket. By limiting groove 113 to only a singular side of body 103, body 103 maintains sufficient rigidity to permit a user to push body 103 through the Gi pants. It is understood that groove 113 is optional but includes the advantage of maximizing performance by removing potential areas where drawstring 99 get caught or rubs against the pocket and dislodges.

In operation, a user obtains body 103 and combines it with drawstring 99 by securing an end of the drawstring to the first end of the body 103. A knot is formed in drawstring 99 and drawstring 99 is inserted into a portion of body 103 within groove 113. Locating drawstring 99 within groove 113 aids in the passage of the drawstring through the pants. The drawstring may be inserted through groove 113 and passed through body 103 past first end 105 prior to forming the knot. Alternatively, the knot may be secured in the notch and then laid externally to body 103. The user opens the drawstring pocket and inserts first end 105 therein with knot 95 secured to the first end. The rigid body of assembly 101 permits a user to push body 103 through the pocket without interference. Once reaching the other side of the pocket, the drawstring knot 95 is released and body 103 is removed from the pocket leaving drawstring 99 therein.

It is understood that a knot is only one form of securing drawstring 99 to the first end 105. Other forms are possible, such as barbs, clamps, clips and others. Drawstring 99 may be included with body 103 as a package in some embodiments. It is also understood that notch 109 may be optional in embodiments wherein groove 113 is used as a user may insert the drawstring from the hollowed groove and push it out first end 105 prior to securing it to body 103. As long as knot 95 is larger than the opening of body 103, the drawstring will be secured. Notch 109 is more important in embodiments without groove 113. Drawstring 99 may be inserted into body 103 from either first end 105 or second end 107.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A stringing or re-stringing assembly for tying Gi pants, comprising:

an elongated body having a first end and a second end, the elongated body being hollow;

a groove in the elongated body passing through the elongated body at the second end and stopping before the first end, the groove exposing an interior of the elongated body; and a notch formed in the first end, the notch being separate from the groove, the notch formed from removing opposing sides of the elongated body at the first end the notch including a notch bottom being a portion of the elongated body configured to separate the notch from the groove.

2. The assembly of claim 1, further comprising:

a drawstring within the elongated body.

3. The assembly of claim 2, wherein the drawstring is located within the groove and the notch.

4. The assembly of claim 2, wherein the drawstring includes a knot located within the notch.

5. The assembly of claim 1, wherein the body is tubular.

6. The assembly of claim 1, wherein the notch passes through opposing sides of the body.

7. A method for restringing Gi pants, comprising:

locating the assembly of claim 1;

locating a drawstring;

passing a drawstring through the groove of the elongated body;

tying a know in the drawstring at the first end;

securing the knot in the notch of the elongated body;

passing the assembly with the drawstring therein through a waistband of a pair of Gi pants; and untying the knot, holding the drawstring within the Gi pant waistband to retain said drawstring within said waistband and pulling the elongated body out and away from the drawstring and waistband so said drawstring is retained within the Gi pant waistband.

8. The method of claim 7, wherein the drawstring is knotted prior to inserting it into the groove.

9. The method of claim 7, wherein the drawstring is inserted into the elongated body from the first end.

10. The method of claim 7, wherein the drawstring is inserted into the elongated body from the second end.

* * * * *